US007111846B1

(12) United States Patent
Breslow et al.

(10) Patent No.: US 7,111,846 B1
(45) Date of Patent: Sep. 26, 2006

(54) TARGET GAME

(75) Inventors: Jeffrey Breslow, Chicago, IL (US); Robert Civettini, Chicago, IL (US); Terry Webb, Aurora, IL (US); Samuel C. Unsicker, Woodridge, IL (US); Zarko Stambolic, Oak Park, IL (US)

(73) Assignee: Big Monster Toys, Chicago, IL (US)

( * ) Notice: Subject to any disclaimer, the term of this patent is extended or adjusted under 35 U.S.C. 154(b) by 0 days.

(21) Appl. No.: 10/720,480

(22) Filed: Nov. 25, 2003

(51) Int. Cl.
*A63F 7/00* (2006.01)

(52) U.S. Cl. ..... 273/342; 273/352; 273/371

(58) Field of Classification Search ..... 273/342, 273/348, 352, 371, 394, 398, 399, 400, 401, 273/402
See application file for complete search history.

(56) References Cited

U.S. PATENT DOCUMENTS 1,313,783 A * 8/1919 Blackburn ..... 273/352
2,806,701 A * 9/1957 Durant ..... 273/352
2,926,915 A * 3/1960 Johns ..... 273/352
3,368,814 A * 2/1968 Kolwicz ..... 273/342
3,689,069 A 9/1972 Rogers
3,782,729 A 1/1974 Ernst
3,818,628 A * 6/1974 Ensmann et al. ..... 446/173
4,119,311 A 10/1978 Jenkins et al.
4,210,328 A 7/1980 Meintzer et al.
5,007,638 A 4/1991 Yukl
5,031,919 A * 7/1991 Dixon ..... 273/352
5,577,733 A * 11/1996 Downing ..... 273/348
5,613,922 A 3/1997 Hsiang
5,658,211 A 8/1997 Glover
5,697,611 A * 12/1997 Kelly et al. ..... 273/126 A
5,769,424 A * 6/1998 Kelly et al. ..... 273/352
5,967,911 A 10/1999 McAvoy
6,502,819 B1 1/2003 Rieber et al.

* cited by examiner

*Primary Examiner*—Raleigh W. Chiu
(74) *Attorney, Agent, or Firm*—Fish & Richardson P.C.

(57) ABSTRACT

Described is a game including a base unit, a target area, a launch area, and an electronic controller. The target area is attached to the base unit and has multiple target sections. The launch area is attached to the base and is configured for bouncing a playing piece into one of the multiple target sections. The electronic controller is configured to monitor the target sections and control game play.

24 Claims, 9 Drawing Sheets

TARGET GAME

TECHNICAL FIELD

This description relates to a target game.

BACKGROUND

Target games which provide a playing piece that is projected toward a target are generally known. In such a game, a player hits a target with a playing piece to score points.

SUMMARY

Described is a game including a base unit, a target area, a launch area, and an electronic controller. The target area is attached to the base unit and has multiple target sections. The launch area is attached to the base and is configured for bouncing a playing piece into one of the multiple target sections. The electronic controller is configured to monitor the target sections and control game play.

Implementations may include one or more of the following features. For example, each target section may include an aperture for receiving the playing piece. The target area may include a series of concentric, upstanding, circular walls, where each circular wall defines one of the multiple target sections. The game also may include a detection system to determine when a playing piece is bounced into one of the multiple target sections. The detection system may be an optical detection system. The optical detection system may include an optical detector located near each aperture and an optical emitter arranged such that a beam emitted from the emitter is directed towards the optical detectors.

The launch area may be formed from a firm material and the playing piece formed from an elastic material. The launch area may be formed from an elastic material and the playing piece formed from a firm material.

The target area may be attached to the base unit such that the base unit and the target area form an obtuse angle.

Other features will be apparent from the following description, including the drawings, and from the claims.

DETAILED DESCRIPTION

Figure 1:
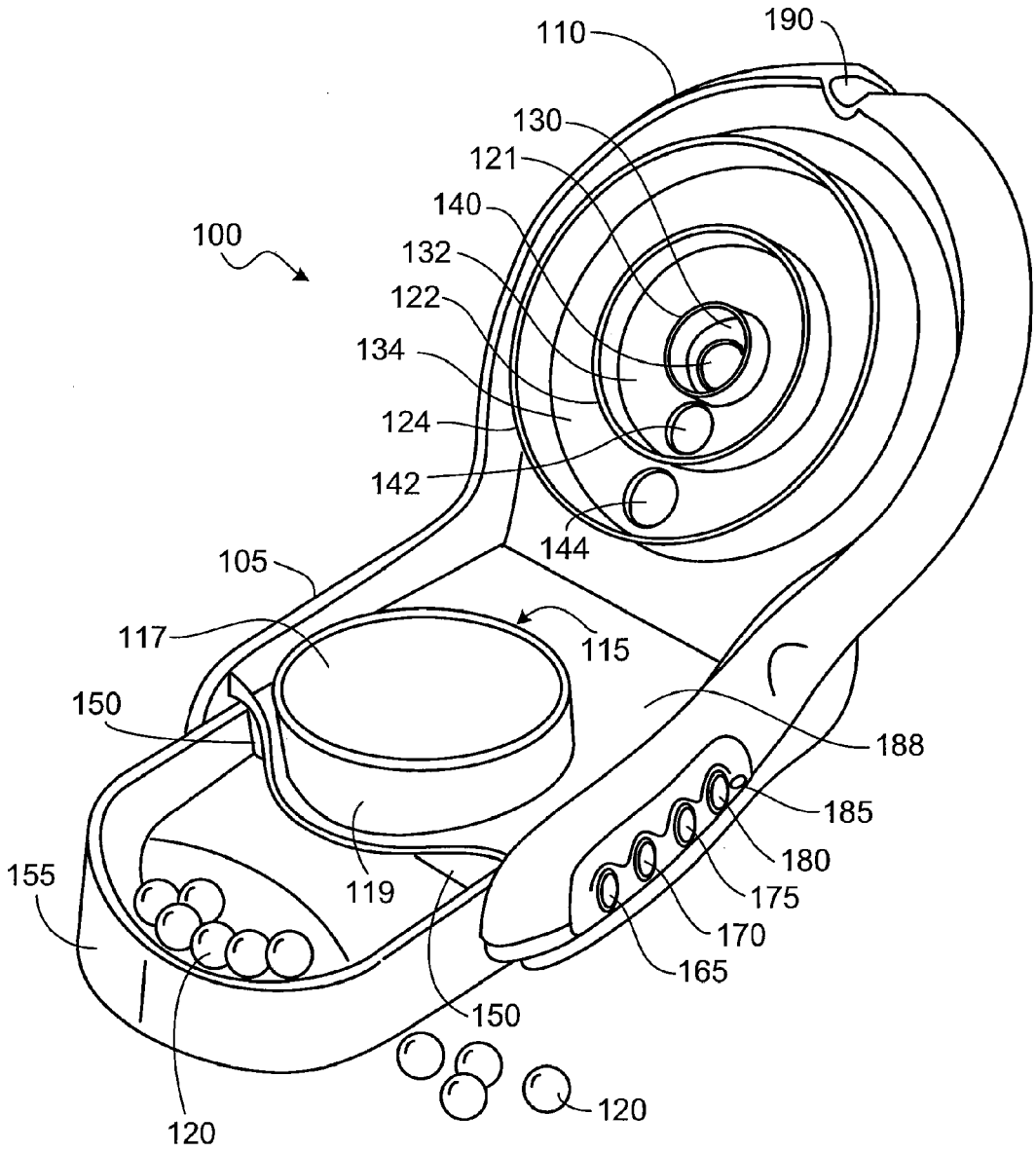
FIG. 1 is a perspective view of a top portion of a target game.
Figure 2:
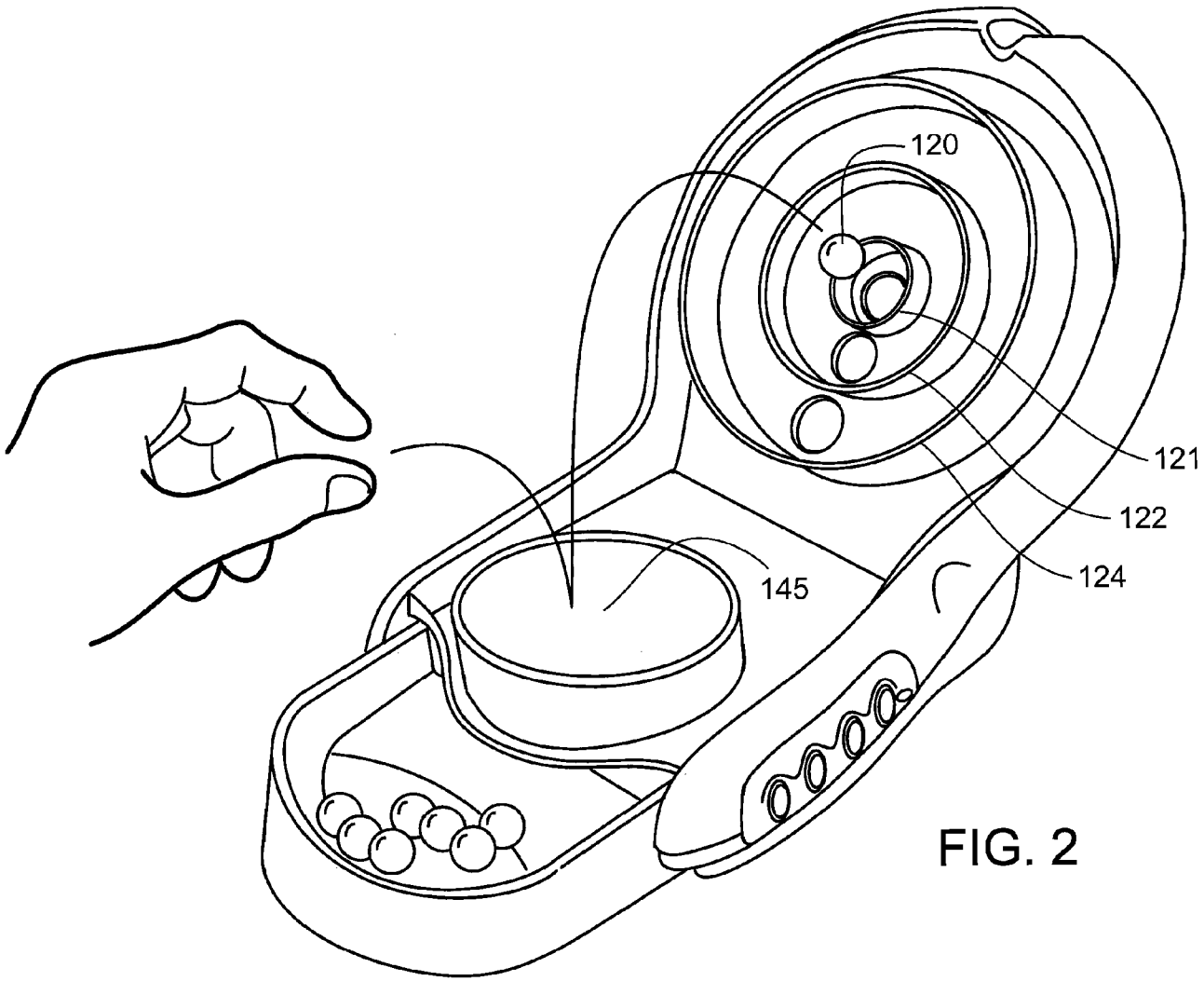
FIG. 2 is a perspective view showing general use of the target game by a user.

Referring to FIGS. 1 and 2, a target game 100 includes a base 105, a target area 110, and a launch area 115. The target area 110 is attached to the base 105 such that the target area 110 and the base 105 define an obtuse angle. The target area 110 includes a series of concentric, upstanding, circular walls 121, 122, and 124 that define, respectively, target sections 130, 132, and 134. Each of the target sections 130, 132, and 134 includes a corresponding aperture 140, 142, or 144. The base unit 105 and target area 110 are made of plastic or other suitable rigid materials.

The base 105 includes a surface 188 in front of the target area 110 to which the launch area 115 is attached. The launch area 115 includes an elastic material 117, such as rubber or nylon, stretched over a plastic ring 119 to form, in effect, a trampoline.

The game 100 also includes playing pieces 120. Playing pieces 120 are made of a firm material, such as metal or plastic, that can be bounced off the elastic launch area 115 into the target area 110.

The game 100 may be sized for table-top play such that, for example, the overall size is less than 2 feet long, less than 1 foot high, and less than 1 foot wide. In one implementation, the game 100 is approximately 12 inches long, approximately 5 inches wide, and approximately 6.5 inches high.

Referring particularly to FIG. 2, game play generally entails bouncing the playing pieces 120 from the launch area or trampoline 115 into the target area 110. In one implementation, a player receives a set number of points for hitting one of the target sections 130, 132, and 134 with a playing piece 120, with the points varying according to which target section is hit. Higher points can be assigned for smaller target sections. For example, in one implementation, the player receives three points for hitting the center section 130, two points for hitting the middle section 132, and one point for hitting the outer section 134.

After a playing piece 120 strikes a target section 130, 132, or 134, the wall 121, 122, or 124 defining the target section guides the playing piece 120 into the corresponding aperture 140, 142, or 144. For instance, after a playing piece 120 strikes target section 132, the wall 122 guides the playing piece 120 into aperture 142.

Figure 3:
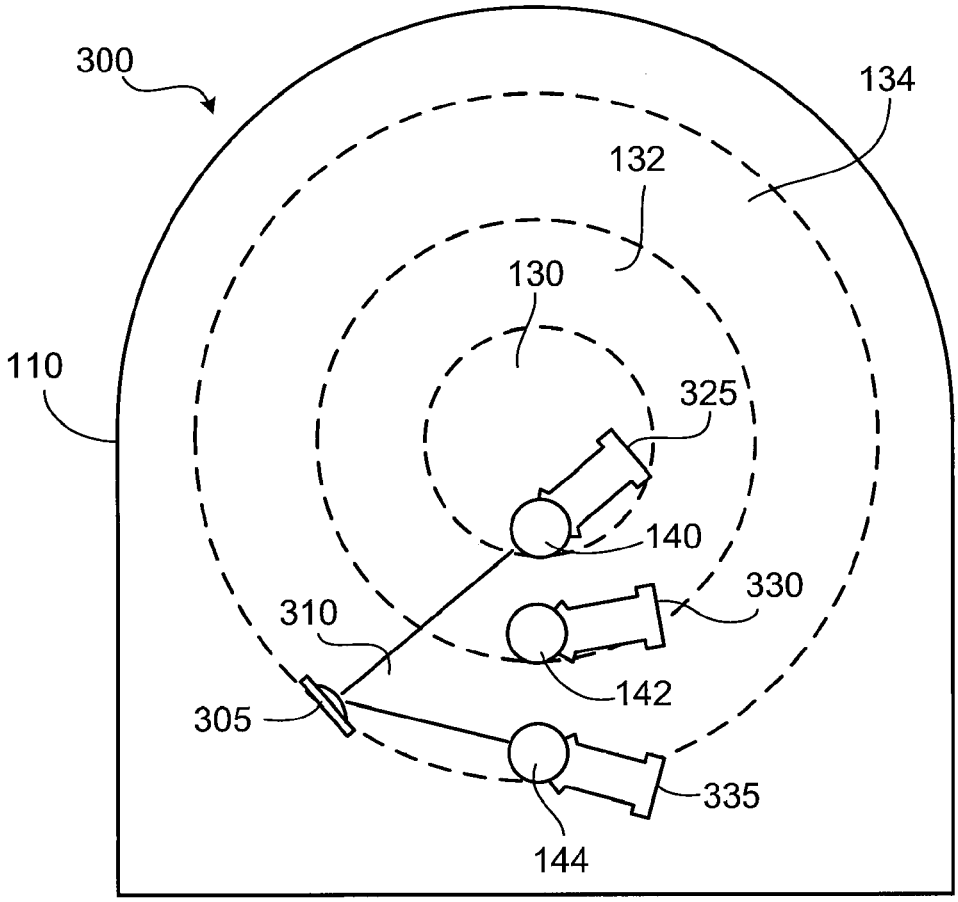
FIG. 3 is a plan view showing an optical detection system of the target game.

Referring to FIG. 3, an optical sensor system 300 detects the passage of playing pieces 120 through the apertures 140, 142, and 144, and provides signals used by the game 100 to increase the score accordingly. The optical sensor system 300 includes an optical emitter 305 (e.g., an infrared light emitter) that emits an optical (e.g., infrared) beam 310 toward three optical (e.g., infrared) detectors 325, 330, and 335 that detect the presence of the beam 910. Each optical detector 325, 330, or 335 is positioned next to a corresponding aperture 140, 142, and 144 on the opposite side from the emitter 305. The passage of a playing piece through an aperture 140, 142, or 144 momentarily interrupts the beam 310. This momentary interruption is detected by the detector 325, 330, or 335 that is located next to the aperture 140, 142, or 144 through which the playing piece 120 passed. The corresponding detector 325, 330, or 335 then signals the game 100 to increase the score.

Game 100 also includes a passage 150 and a tray 155 that are attached to the base 105 such that tray 155 engages passage 150. Passage 150 also is connected to the apertures 140, 142, and 144. As a result, playing pieces 120 that enter the apertures 140, 142, and 144 move through the passage 150 to the tray 155. The tray 155 holds playing pieces 120 during game play and may include a cover (not shown) to hold pieces securely while the game is not in use.

In the event that a playing piece misses a target section 130, 132, or 134, the playing piece 120 may fall back and strike surface 188. Surface 188 is oriented so that the playing piece that misses the target sections 130, 132, and 134 and falls back to strike the surface 188 will return to the tray area 155.

The game 100 also includes control buttons 165–185 located on the base 105. The control buttons 165–185 allow a player to control aspects of the game 100. The ON/GAME button 165 activates the game when initially pressed and is used subsequently to select one of several game modes (which are further described below) for play. Pressing the SCORE button 170 causes the score to be announced. Pressing the SOUND button 175 adjusts the speaker volume. Pressing the OFF button 180 turns the game off. Pressing the RESET button 185 erases the game's memory of any best scores and times (described below).

Figure 4:
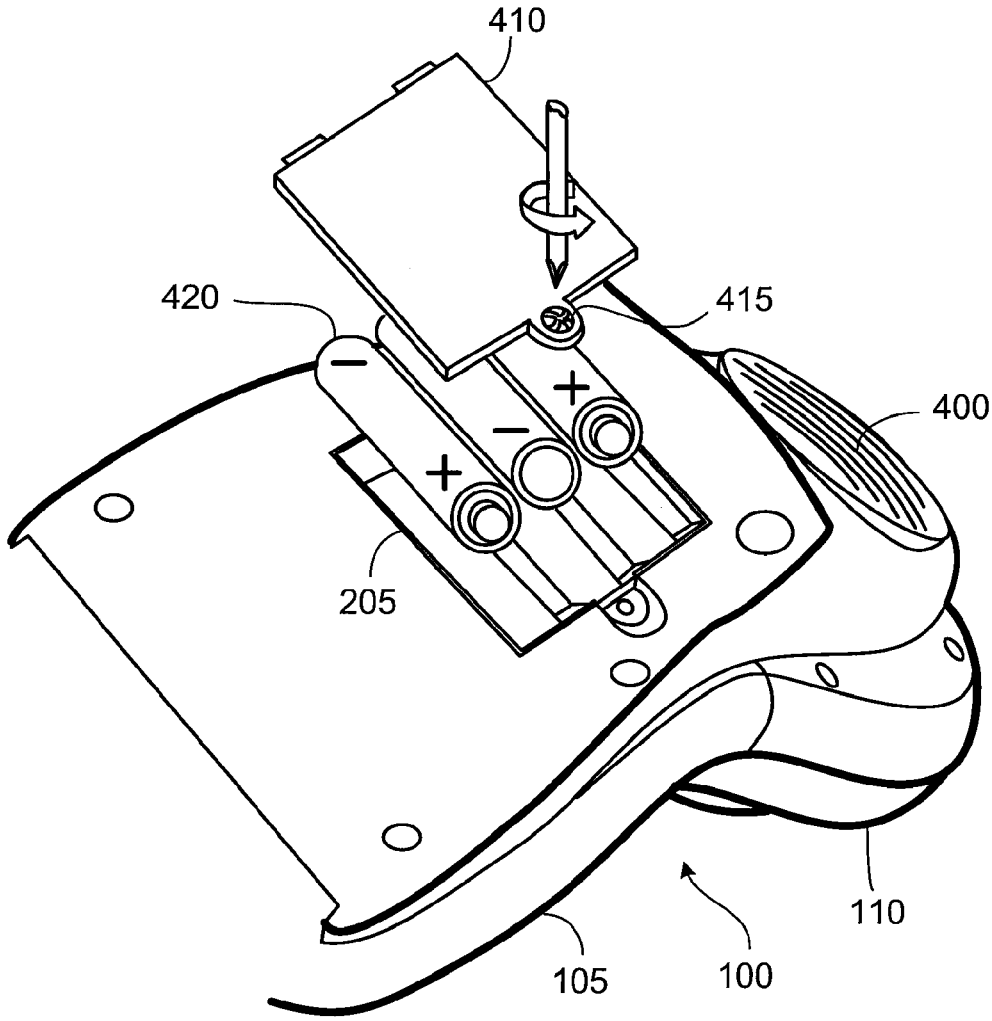
FIG. 4 is a perspective view of a bottom portion of the target game.

The game 100 further includes a visual feedback mechanism in the form of a light 190 (or, in other implementations, an alphanumeric display) mounted at the top of the target area 110. Referring also to FIG. 4, the game 100 also includes a speaker 400 that is mounted at the back of the target area 110. The speaker 400 (or other audio feedback mechanism) is used to emit voice, music, or other sounds. These audio and visual feedback mechanisms are used to inform the player of certain aspects of the game, such as game mode selection, current time or score, or best time or score.

As shown in FIG. 4, the underside of the base 105 includes a power source compartment 405 that is closed by a cover 410 and secured in place by a screw 415. The compartment 405 holds batteries 420. In other implementations, the base includes a port (not shown) to which an external power source is connected.

Figure 5:
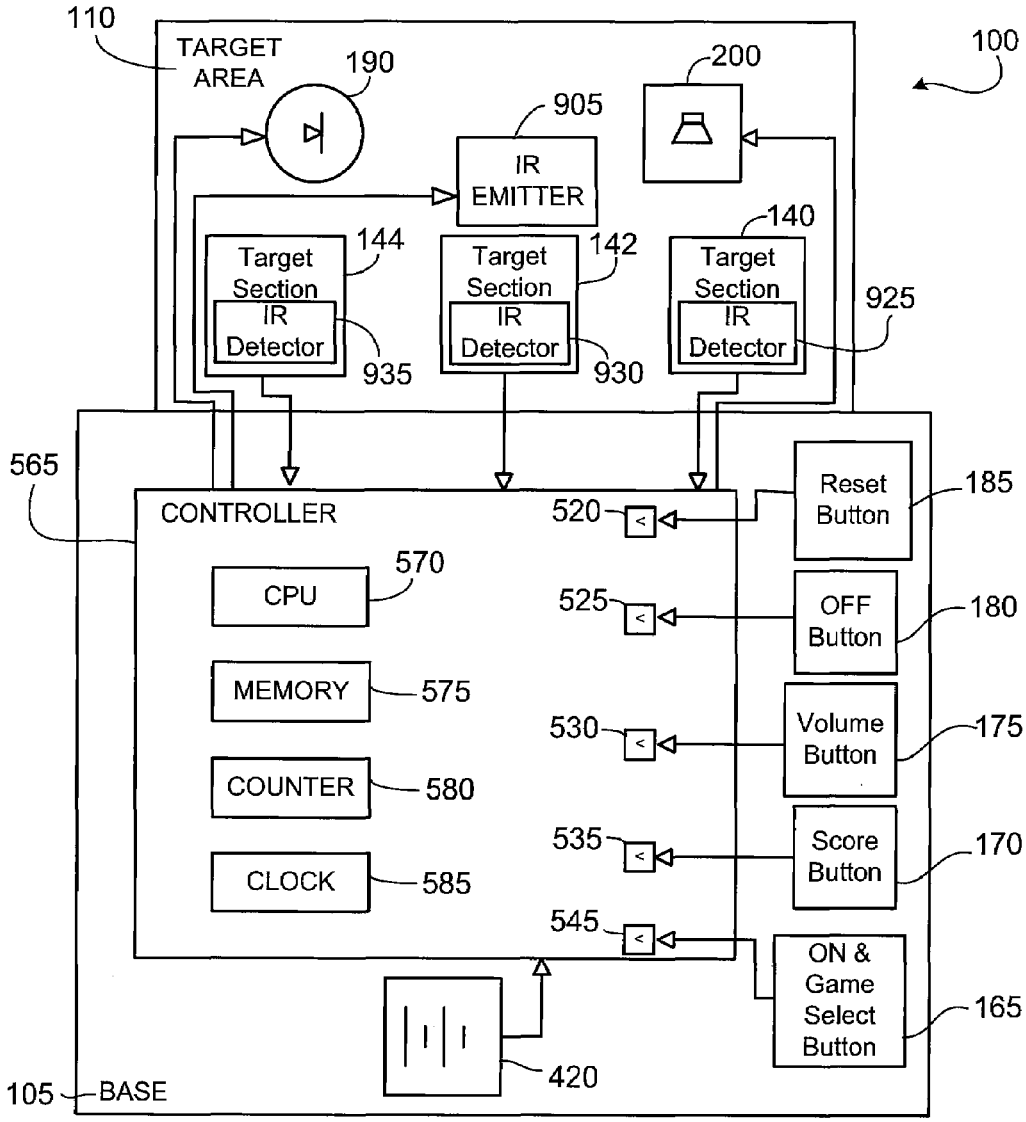
FIG. 5 is a schematic diagram of the target game's electrical system.

Referring to FIG. 5, a control system provides electrical power and control of the game 100. A controller 565 is housed inside the base 105 and includes a processor 570, a memory 575, a counter 580, and a clock 585. The controller 565 receives inputs from the control buttons 165–185 and corresponding switches 520–545 and the optical detectors 325–335. The controller 565 receives power from the power source 420. The controller 565 uses the inputs from control buttons 165–185 and optical detectors 325–335 to control game play and to produce outputs that control the optical emitter 305, the speaker 400, and the light 190.

Figure 6:
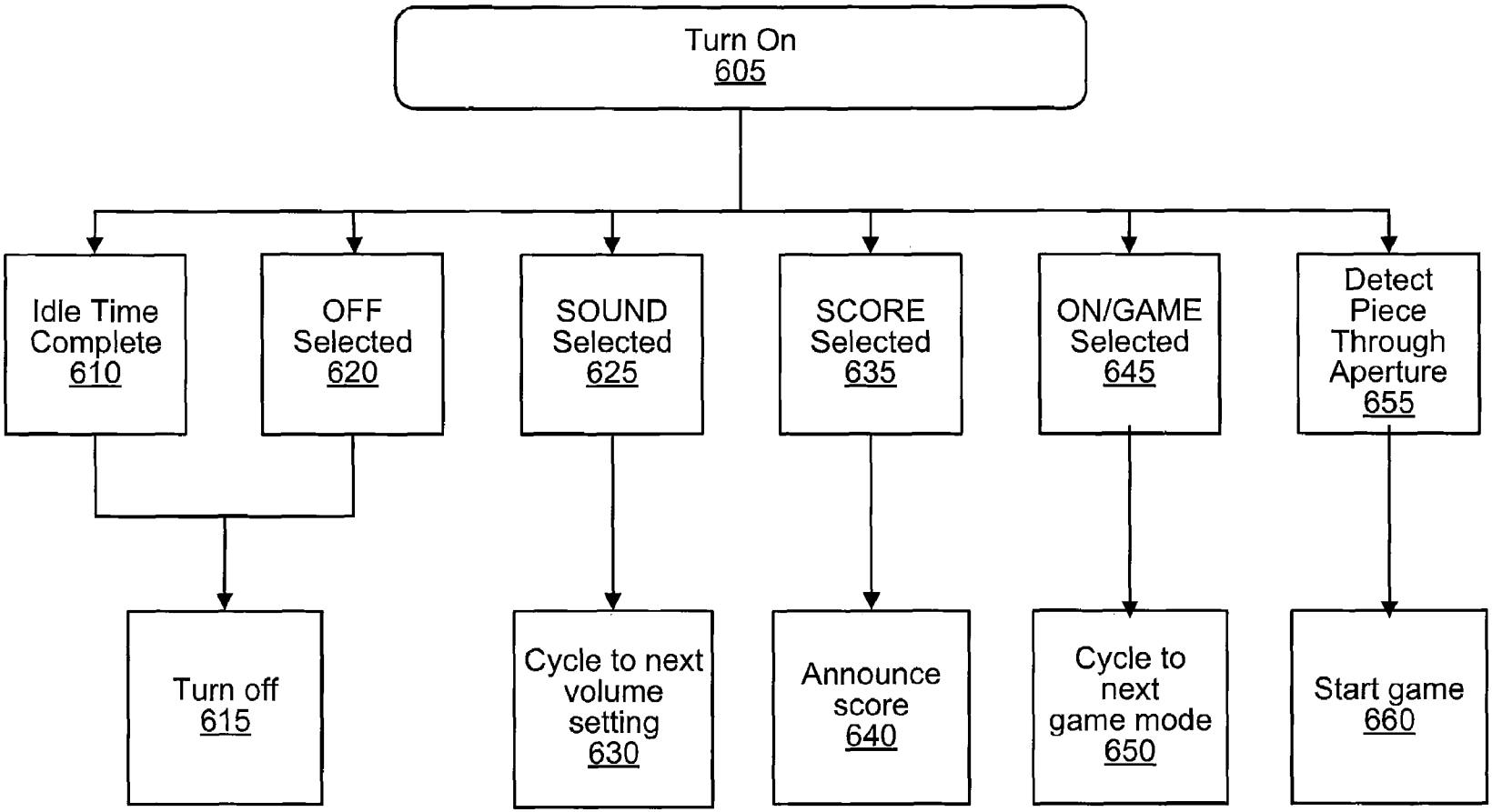
FIGS. 6–9 are a flow charts showing procedures implemented by a controller of the target game.

Referring to FIG. 6, the controller 565 implements a procedure 600 to control game play. Initially, the game is turned on (step 605) when the ON/GAME button 165 is pressed. The controller 565 determines if any of the switches 520–545 or optical detectors 325–335 has been activated within a set amount of time (for example, 60 seconds) (step 610) and, if not, the controller 565 causes the game to automatically turn off (step 615). Similarly, if the OFF button is pressed (step 620), the controller 565 causes the game to turn off (step 615).

When the SOUND button 175 is selected (step 625), the controller 565 cycles to the next volume level (step 630). The volume levels include, for example, high, low, and off.

When the SCORE button 170 is selected (step 635), the controller causes the score of the most recent game played to be announced by speaker 200 (step 640).

When the ON/GAME button 165 is selected (step 645), the controller 565 cycles to the next game mode (650). Game 100 includes four game modes, a 30-SECOND BLITZ game mode, a 25-POINT RUSH game mode, a BULLS-EYE ACE game mode, and a PRACTICE game mode. The objective of the 30-SECOND BLITZ game mode is to score the most points in a predetermined time period, e.g. 30 seconds. The objective of the 25-POINT RUSH game mode is to score twenty-five points in the least amount of time. The objective of the BULLS-EYE ACE game mode is to score the most bulls-eyes by hitting the center target section 130 before missing the center target section 130 a set number of times, e.g. ten times. Lastly, the PRACTICE game mode allows a player to bounce playing pieces 120 at the target area 110 with no limits on time, number of balls, or misses.

When an optical detector 325, 330, or 335 signals to controller 565 that a playing piece 120 has passed through an aperture 140, 142, or 144 (step 655), then a game according to the presently selected game mode is initiated (step 660).

Figure 7:
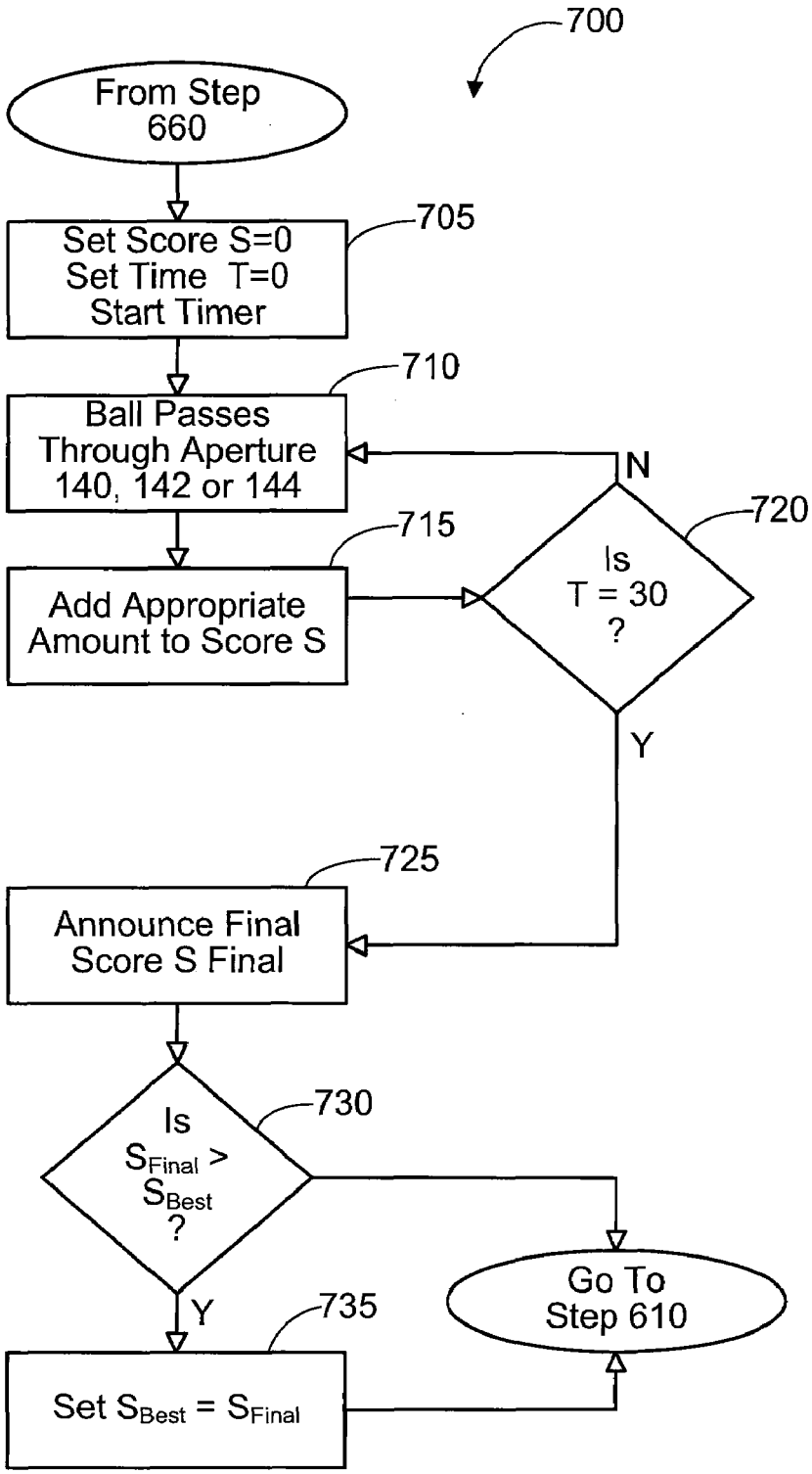

Referring to FIG. 7, a process 700 is performed by controller 565 to implement the 30-SECOND BLITZ game mode. Initially, a score S and a time T are set to zero and a timer is started (step 705). If an optical sensor 325, 330, or 335 indicates a playing piece 120 has passed through an aperture 140, 142 or 144 (step 710), the appropriate amount (e.g., 3 points, 2 points, or 1 point) is added to the score S (step 715). The game continues until the time T has reached thirty seconds (step 720). At that point, the final score SFINAL is announced (step 725) and, if SFINAL is greater than the best score SBEST (step 730), SFINAL is recorded as the new SBEST (step 735).

Figure 8:
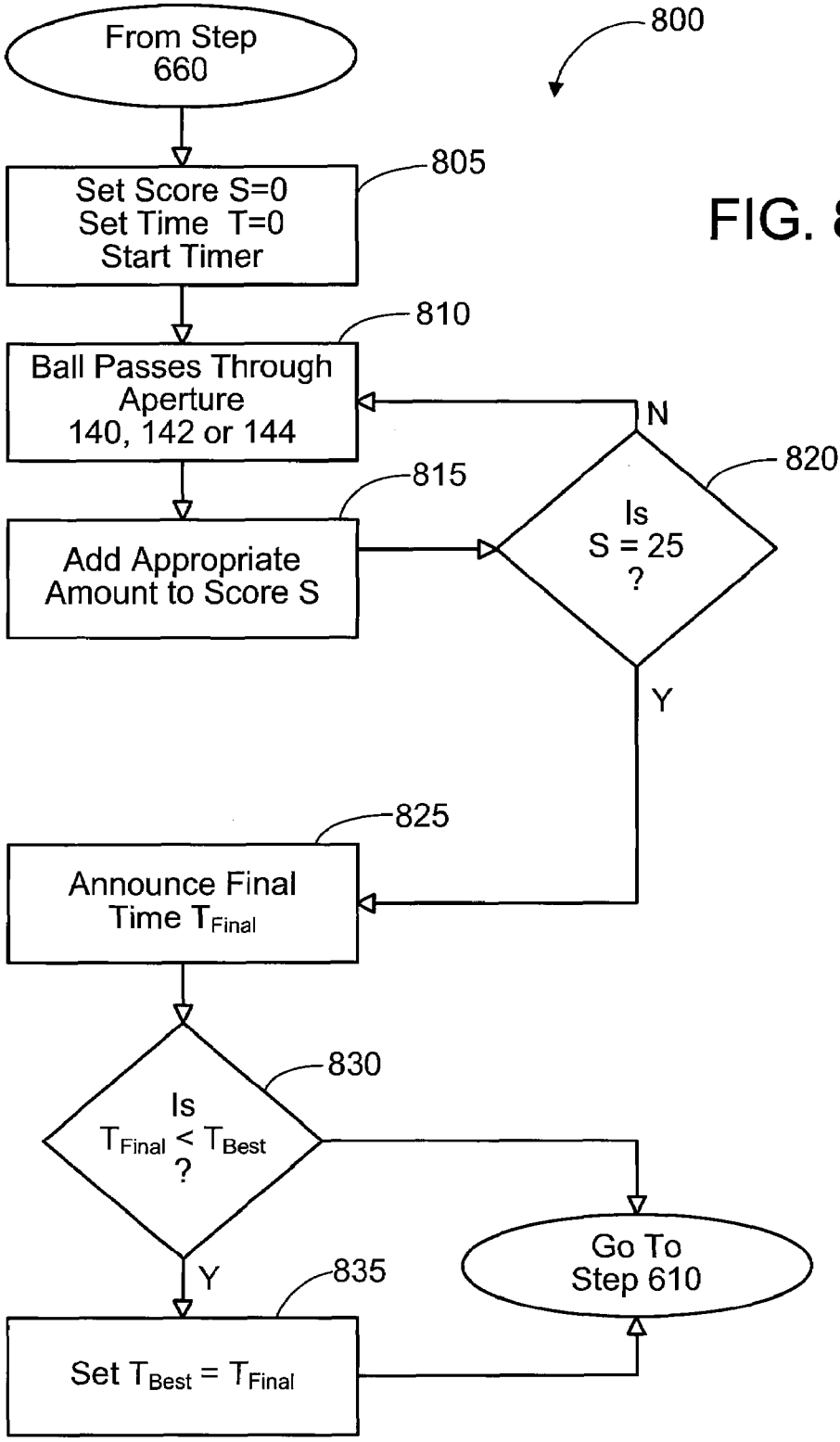

Referring to FIG. 8, a process 800 is performed by controller 565 to implement the 25-POINT RUSH game mode. When the game starts, the score S and the time T are set to zero and the timer is started (step 805). If an optical sensor 325, 330, or 335 indicates a playing piece 120 has passed through an aperture 140, 142 or 144 (step 810), the appropriate amount (e.g., 3 points, 2 points, or 1 point) is added to the score S (step 815). The game continues until the score S has reached twenty-five points (step 820). At that point, the final time TFINAL is announced (step 825) and, if TFINAL is less than the best time TBEST (step 830), TFINAL is recorded as the new TBEST (step 835).

Figure 9:
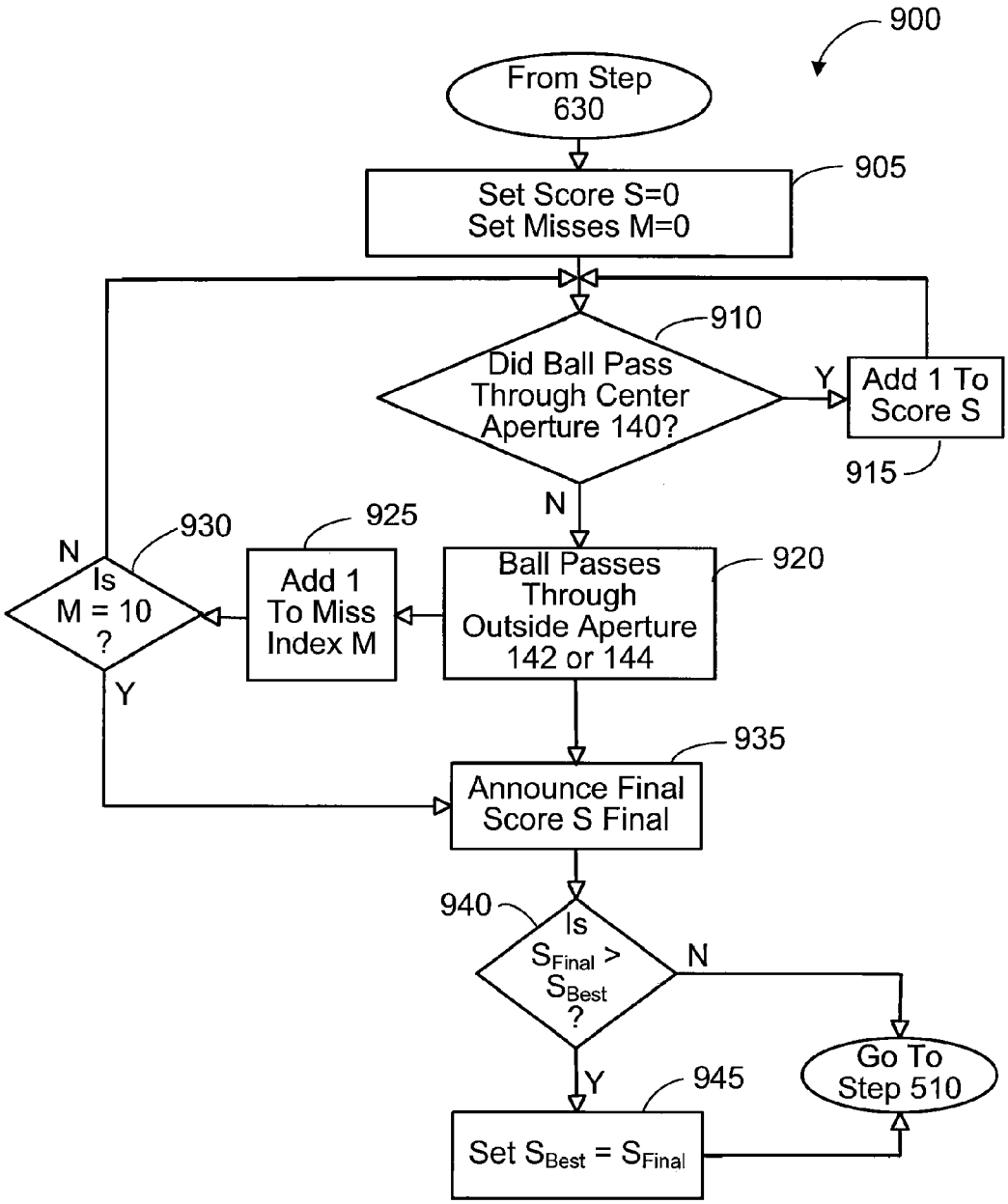

Referring to FIG. 9, a process 900 is performed by controller 565 to implement the BULLS-EYE ACE game mode. Initially, the score S and a miss index M are set to zero (step 905). If a ball passes through the center aperture 140 (step 910), one is added to the score S (step 915). If a ball passes through one of the two outside apertures 142 or 144, one is added to the miss index M (step 925). Play continues until the miss index M reaches 10 (step 930). At that point, the final score SFINAL is announced (step 935) and, if SFINAL is greater than the best score SBEST (step 940), SFINAL is recorded as the new SBEST (step 945).

All of the game modes may incorporate music, voice, or other sounds from the speaker 200, flashes from the light 190, or a display of time or score from the alphanumeric display (not shown).

A number of implementations have been described. Nevertheless, it will be understood that various modifications may be made. For example, sensors other than optical sensors (e.g., magnetic or mechanical sensors) may be used to detect passage of a playing piece 120 through an aperture 140, 142, or 144.

Also, in other implementations, the launch area 115 may be made of a firm material, such as plastic or metal, and the playing pieces 120 may be made of an elastic material, such as rubber, such that the elastic playing pieces 120 bounce off the firm launch area 115 into the target area 110.

Other game sizes may be used. For instance, larger versions may be implemented for play at, for example, an amusement park.

Some implementations also may allow one game unit to be electronically connected to other game units for multiple players to play simultaneously.

Other implementations are within the scope of the following claims.

What is claimed is:

1. A game comprising:

a base unit;

a target area attached to the base unit and having multiple target sections, the target area defining multiple, separate apertures, each aperture located in one of the multiple target sections;

a launch area attached to the base and configured such that a playing piece tossed onto the launch area bounces into one of the multiple target sections and passes through the corresponding aperture of the target section;

an optical detection system to detect which one of the multiple, separate apertures the playing piece passed through, the optical detection system comprising at least two optical detectors, each optical detector located near an associated one of the apertures, and a common optical emitter arranged such that a beam emitted from the emitter is received by the at least two optical detectors;

an input configured to allow the player to select one of at least two game modes, wherein each of the two game modes has a different objective for game play;

an electronic controller configured to:

receive a signal from the optical detection system that indicates which aperture the playing piece passed through and to control game play based on which aperture the playing piece passed through; and control game play according to the game mode selected by a player of the game.

2. The game of claim 1 wherein the optical detectors and the common optical emitter are arranged such that the playing piece passing through one of the apertures momentarily disrupts a portion of the beam received by the optical detector located near the aperture through which the playing piece passes, causing the optical detector near the aperture through which the playing piece passes to generate the signal that indicates which aperture the playing piece passed through.

3. The game of claim 1 wherein the target area further comprises a series of concentric, upstanding, circular walls, each circular wall defining one of the multiple target sections.

4. The game of claim 1 wherein the base unit, the target area, and the launch area are sized for table-top play of the game.

5. The game of claim 1 wherein the launch area is formed from a firm material and the playing piece is formed from an elastic material.

6. The game of claim 1 wherein the launch area is formed from an elastic material and the playing piece is formed from a firm material.

7. The game of claim 1 wherein the target area is attached to the base unit such that the base unit and the target area form an obtuse angle.

8. A game comprising:

a base unit;

a target area attached to the base unit and having multiple target sections, the target area defining multiple, separate apertures, each aperture located in one of the multiple target sections;

means for receiving a playing piece such that the playing piece bounces into one of the multiple target sections and passes through the corresponding aperture of the target section;

means for detecting which one of the multiple, separate apertures the playing piece passed through, the means for detecting which aperture the playing piece passes through comprising at least two optical detectors, each optical detector located near an associated one of the apertures, and a common optical emitter arranged such that a beam emitted from the emitter is received by the at least two optical detectors;

an input configured to allow the player to select one of at least two game modes, wherein each of the two game modes has a different objective for game play;

an electronic controller configured to:

receive a signal from the optical detection system that indicates which aperture the playing piece passed through and to control game play based on which aperture the playing piece passed through; and control game play according to the game mode selected by a player of the game.

9. The game of claim 8 wherein the target area further comprises a series of concentric, upstanding, circular walls, each circular wall defining one of the multiple target sections.

10. The game of claim 8 wherein the base unit, the target area, and the means for receiving a playing piece are sized for table-top play of the game.

11. A game comprising:

a base unit;

a target area attached to the base unit and having multiple target sections, each target section including an aperture;

a launch area attached to the base unit and configured such that a playing piece tossed onto the launch area bounces into one of the multiple target sections and passes through the corresponding aperture of the target section;

an input configured to allow a player to select one of at least two game modes, wherein each of the two game modes has a different objective for game play;

at least one sensor configured to detect when a playing piece passes through one of the apertures; and an electronic controller operatively connected to the input and the at least one sensor to control game play according to a game mode selected by the player.

12. The game of claim 11 wherein the target area further comprises a series of concentric, upstanding, circular walls, each circular wall defining one of the multiple target sections.

13. The game of claim 12 wherein the at least one sensor comprises an optical detector located near each aperture and a single optical emitter arranged such that a beam emitted from the emitter is received by the optical detectors.

14. The game of claim 11 wherein each one of the multiple targets is assigned a different point value and the objective of one of the at least two game modes is to obtain the most points in a predetermined time period by bouncing the playing piece into one or more of the multiple target sections.

15. The game of claim 11 wherein each one of the multiple targets is assigned a different point value and the objective of one of the at least two game modes is to obtain a particular amount of points in the least amount of time.

16. The game of claim 11 wherein the objective of one of the at least two game modes is to bounce the playing piece into a predetermined one of the multiple target sections a predetermined number of times.

17. A game comprising:

a base unit;

a target area attached to the base unit and having multiple target sections, each target section including an aperture that opens to a passage common to the apertures;

a launch area attached to the base unit and configured such that a playing piece tossed onto the launch area bounces into one of the multiple target sections and passes unimpeded through the corresponding aperture of the target section directly into the passage common to the apertures;

an optical detection system to detect which aperture the playing piece passed through to directly enter the passage common to the apertures;

an input configured to allow the player to select one of at least two game modes, wherein each of the two game modes has a different objective for game play;

an electronic controller configured to:

receive a signal from the optical detection system that indicates which aperture the playing piece passes through and to control game play based on which aperture the playing piece passes through; and control game play according to a game mode selected by a player of the game.

18. The game of claim 17 wherein the target area further comprises a series of concentric, upstanding, circular walls, each circular wall defining one of the multiple target sections.

19. The game of claim 17 wherein each one of the multiple targets is assigned a different point value and the objective of one of the at least two game modes is to obtain the most points in a predetermined time period by bouncing the playing piece into one or more of the multiple target sections.

20. The game of claim 17 wherein each one of the multiple targets is assigned a different point value and the objective of one of the at least two game modes is to obtain a particular amount of points in the least amount of time.

21. The game of claim 17 wherein the objective of one of the at least two game modes is to bounce the playing piece into a predetermined one of the multiple target sections a predetermined number of times.

22. The game of claim 17 wherein the optical detection system comprises an optical detector located near each aperture and a single optical emitter arranged such that a beam emitted from the emitter is received by the optical detectors.

23. The game of claim 17 wherein the base unit, target area, launch area, and tray are sized for table-top play of the game.

24. The game of claim 22 wherein the optical detectors and single optical emitter are arranged such that the playing piece passing through an aperture momentarily disrupts a portion of the beam received by the optical detector located near the aperture through which the playing piece passes, causing the optical detector near the aperture through which the playing piece passes to generate the signal that indicates which aperture the playing piece passed through.

* * * * *